United States Patent [19]

Bates et al.

[11] Patent Number: 4,859,257

[45] Date of Patent: Aug. 22, 1989

[54] FINE GRAINED EMBRITTLEMENT RESISTANT TANTALUM WIRE

[75] Inventors: Victor T. Bates, Kenosha, Wis.; Charles Pokross, Gurnee, Ill.

[73] Assignee: Fansteel Inc., North Chicago, Ill.

[21] Appl. No.: 253,898

[22] Filed: Oct. 4, 1988

Related U.S. Application Data

[63] Continuation of Ser. No. 823,781, Jan. 29, 1986, abandoned.

[51] Int. Cl.[4] ..... C22C 27/00

[52] U.S. Cl. ..... 148/422

[58] Field of Search ..... 148/422; 420/427, 425, 420/424

[56] References Cited

U.S. PATENT DOCUMENTS 3,497,402 2/1970 Douglass et al. ..... 148/422

*Primary Examiner*—R. Dean

*Attorney, Agent, or Firm*—Barnes, Kisselle, Raisch, Choate, Whittemore & Hulbert

[57] ABSTRACT

Tantalum and tantalum-based alloys, particularly in wire form, are significantly improved in retention of a fine grain size at elevated temperatures and in resistance to embrittlement by the addition of 10 to 1000 ppm silicon and 10 to 1000 ppm thorium-containing material.

18 Claims, 1 Drawing Sheet

FINE GRAINED EMBRITTLEMENT RESISTANT TANTALUM WIRE

This is a continuation of co-pending application Ser. No. 823,781, abandoned filed on Jan. 29, 1986.

BACKGROUND OF THE INVENTION

The present invention is directed to tantalum-based metal alloys, and more particularly to wire wrought from such alloys.

Electrolytic capacitors and furnace components in high temperature vacuum furnaces are major application areas for tantalum. Properties of tantalum that make it an attractive material in these applications include: high melting point, high dielectric constant in the tantalum oxide film formed by anodizing, good electrical conductivity, excellent fabricability and ductility, and availability in high purity forms. Other desirable properties or characteristics or tantalum for these applications are: resistance to embrittlement, fine grain size and resistance to grain growth, and good weldability, including joints to dissimilar materials.

Tantalum is known to become embrittled when exposed to gases such as oxygen, carbon monoxide and carbon dioxide for only short times at temperatures of about 315° C. (600° F.) and higher. These and other contaminating gases comprise the products or reactants of many physical and chemical reactions involving the use of tantalum products, either directly or indirectly, in the electronics, metal and chemical industries. The "embrittlement" condition refers to the loss of desired ability to bend without breaking in the intended application (as observed and measured at or near room temperature) resulting from exposure of tantalum to high temperatures in unsuitable vacuums or in contaminating gases and vapors. The lack of low temperature ability to bend without breaking after contamination causes severe problems when fabricated parts of tantalum that have been contaminated are subsequently exposed to vibration, impact and static forces at or near room temperature during use or subsequent manufacture.

One of the major difficulties in the use of tantalum in electrolytic capacitors has been that tantalum lead wires often become severely embrittled during sintering of slug-type tantalum anodes produced by pressing and sintering of tantalum powder with the tantalum lead wire embedded in the powder slugs. The extend of embrittlement is known to be more severe when such tantalum lead wires are embedded in tantalum powders having a relatively high oxygen content—for example, more than 1600 parts per million—and with powders sintered at temperatures of 1800° C. or higher. Embrittlement of tantalum lead wires is a major problem when handling anodes that are welded to the rack employed in the anodizing process. Embrittlement is most severe in the area where the tantalum lead wire is embedded into the tantalum powder slug. Maximum or peak embrittlement is noted at the point of egress of the wire from the sintered anode, where the oxygen content in the wire is high and where the wire is unsupported. Embrittlement of tantalum lead wires is a major consideration in ability to withstand further capacitor manufacturing operations and handling. A solution to the tantalum lead wire embrittlement problem has a strong bearing on the ability to manufacture capacitors economically.

Furthermore, embrittlement of wrought tantalum fabricated components in high temperature furnace or other high temperature applications can adversely affect life of the parts. Tantalum materials in high temperature applications are adversely affected because they act as "getters" for contaminant gases such as carbon monoxide, carbon dioxide, oxygen and nitrogen. Grain growth at elevated temperature is also a significant problem. Coarse grain size tends to increase embrittlement and cracking when contaminated with relatively small amounts of oxygen. Replacement of tantalum parts because of embrittlement and failure can cause lengthy down-time and result in a sizable replacement costs. Substantial economical benefits can be gained if the service life of such tantalum parts can be increased.

One method that has been used to overcome this difficulty has been to treat the surface of the tantalum lead wire with carbon or a carbonaceous material. The carbon coating tends to react with oxygen in the tantalum powder during the subsequent high-temperature sintering operation, so that bendability of the lead wire is maintained because the oxygen has reacted with the carbon coating rather than being absorbed into the tantalum lead wire. However, it is difficult to control the application of carbon to obtain consistent properties and to maintain the desired bendability in the lead wire. In addition, carbon on the surface of the wire exerts an adverse effect on the electrical properties of the tantalum by producing an undesired increase in DC leakage through the tantalum oxide dielectric film of the resulting capacitor.

Still another method that has been used in an effort to lessen the extend of embrittlement of a tantalum lead wire is to use a grain-size-controlled tantalum lead wire—i.e., a tantalum wire that exhibits a grain size that does not grow significantly upon exposure to the elevated temperatures employed during sintering of the anode. However, a grain-size-controlled lead wire still does not possess the desired resistance to embrittlement in many instances, especially in those applications where the grain-size-controlled tantalum lead wire is embedded in a high-oxygen containing tantalum powder slug, and most especially where the oxygen content of the tantalum powder is 1600 ppm or higher.

In accordance with Marsh et al U.S. Pat. Nos. 4,062,679, 4,128,421 and 4,235,629, assigned to the assignee of the present invention and incorporated herein by reference, addition of sufficient silicon to provide from about 50 to 700 parts per million (ppm) silicon relatively uniformly distributed in the metal reduces the embrittlement of tantalum and tantalum-base alloys. The silicon-containing tantalum compositions are made by powder-metallurgy pressing and sintering techniques by first blending silicon into a master alloy blend of relatively high silicon content, and then blending the master alloy blend into the total composition. The final blend is pressed and sintered to produce a dense bar which is then fabricated as desired. In the fabrication of tantalum wire, the bar is subjected to multiple cold rolling steps, and then to multiple wire drawing steps, until wire of the desired diameter is obtained.

Torti U.S. Pat. No. 3,268,328, utilizes 10 to 1000 ppm addition of elements having atomic numbers 39 (yttrium) and 57 through 71 (lanthanum and rare earths) to provide ductile wrought tantalum and tantalum-alloy products with fine grain size which is resistant to grain coarsening at elevated temperatures. Douglass et al U.S. Pat. No. 3,497,402 discloses a process for producing a cold worked annealed tantalum alloy containing between about 10 and 1000 ppm yttrium which has a grain size finer than ASTM No. 3 upon heating to 2038° C. (3700° F.) for one hour. Good ductility and strength properties are also claimed for the yttrium-containing materials.

Other additives have been made to wrought metal products to achieve a fine initial grain size, an increased recrystallization temperature, and resistance to grain growth at elevated temperatures. Thoria and zirconia, which are very refractory oxides, remain in tungsten products through high-temperature sintering processes and restrain grain growth during heating at the operating temperature of a lamp filament. (Yih, S. W. H. and C. T. Wang, "Tungsten Sources, Metallurgy, Properties and Applications", Plenum Press, N.Y., 1979). Thoria and zirconia are added as a nitrate or chloride to the tungsten oxide, whether yellow, blue or brown, and depending upon the reduction process employed. The amount of thoria or zirconia may be up to 4 or 5% of the calculated final weight of tungsten metal powder to be reduced. After blending, the tungsten oxide is air dried and reduced in a hydrogen furnace. The reduced produce is screened and blended with pure tungsten powder as required in order to obtain a powder with 1 or 2% of the refractory oxide.

Good weldability is required in tantalum and tantalum alloy materials for many applications. In the case of tantalum lead wires for tantalum electrolytic capacitors, good weldability may be required in seal-welding the wire to the capacitor case, or joining the wire to another tantalum wire or to a metal wire such as nickel.

OBJECTS AND SUMMARY OF THE INVENTION

State-of-the-art wires have not provided all of the desired qualities for capacitor requirements, especially regarding the combination of good resistance to embrittlement, maintenance of fine grain size through all manufacturing steps, and weldability. It is a general object of the present invention to overcome these deficiencies in the art. It is a more specific object of the invention to provide an improved method of forming wrought tantalum-based products having increasing resistance to embrittlement and grain growth, and increasing weldability, as compared with prior art techniques, and also to provide the resulting products.

In accordance with the present invention, improved characteristics are obtained in tantalum products by addition of silicon in combination with one or more metal oxides that possess high free energies of formation, and are therefore highly stable thermodynamically with respect to tantalum. The metal oxide is dispersed as a separate phase in the tantalum—i.e. does not go into solution—and functions to stabilize the tantalum grain boundaries. Thoria (thorium oxide) is preferred.

The silicon addition to tantalum material compositions of this invention is made by powder-metallurgy methods in accordance with Marsh et al U.S. Pat. Nos. 4,062,679, 4,128,421 and 4,235,629 previously noted. Typically, finely divided silicon powder is blended with a finely divided tantalum powder in an amount to produce a nominal silicon concentration between 1 to 5 weight percent in a master blend. This master blend is then blended with additional finely divided tantalum powder in proportions to provide a nominal silicon content about 2 to 3 times as high as the desired silicon content in final composition. This is done because a substantial portion of the silicon is lost by volatilization during high temperature processing.

The thorium addition is made in the form of a stable thorium compound, such as thorium nitrate, which can be dispersed relatively uniformly in the tantalum powder blend. Typically, a thorium nitrate solution is prepared to contain the amount of thorium desired in the final composition. This solution is added to and blended with the final tantalum-plus-silicon powder blend, and then dried at a temperature of about 65° C. (150° F.). The resulting dried powder blend is compacted and sintered under high vacuum (typically less than $10^{-5}$ torr) to produce a dense bar, which is then fabricated as desired. For the fabrication of wire, the bar is subject to a series of cold rolling steps, followed by a series of wire drawing steps, until the desired wire diameter is obtained.

BRIEF DESCRIPTION OF THE DRAWINGS

The improved characteristics demonstrated by the combination of silicon and thorium additions are shown in the accompanying Examples and Figures in which.

EXAMPLE 1

Figure 1:
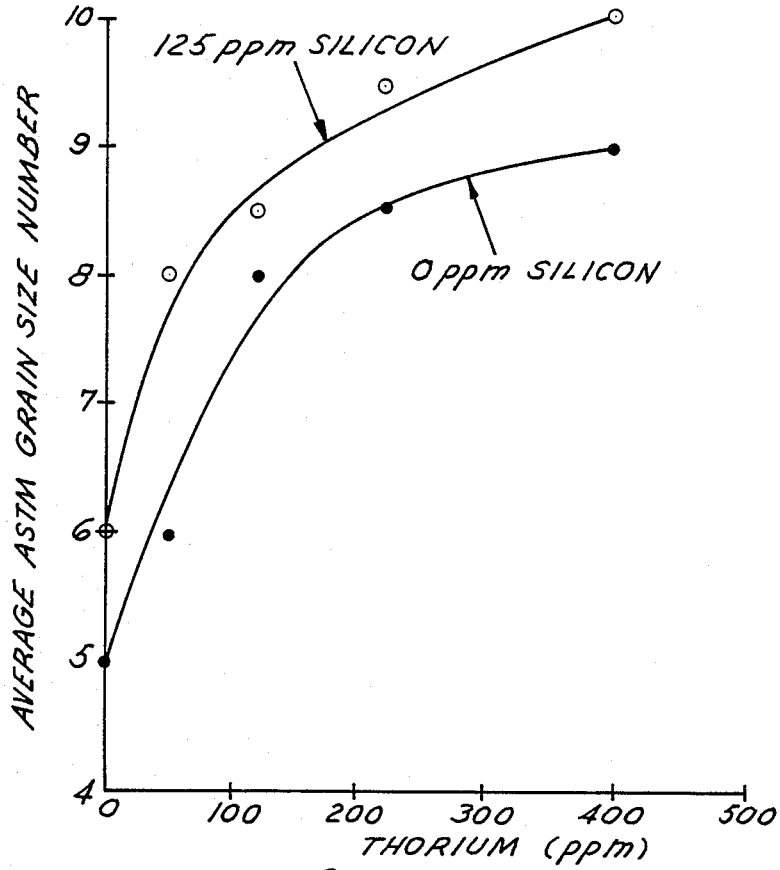
FIG. 1 is a graphic illustration of average grain size of tantalum wire as a function of thorium content, at two levels of silicon content, with the wire being vacuum annealed at 2000° C. for 30 minutes.

A tantalum-silicon master alloy blend was prepared by blending 3 parts by weight of −200 mesh elemental silicon powder with 97 parts by weight of −325 mesh high purity tantalum powder. The blend was out-gassed under vacuum at 1325° C. for 3 hours, jaw crushed, milled and screened to −325 mesh. This master blend was then mixed with additional high purity tantalum powder to provide a powder blend containing 125 ppm silicon. Additionally, 50 ppm contained thorium was added to the blend in the form of an aqueous solution of thorium nitrate, $Th(NO_3)_4$. The powder was then blended and dried in a rotary dryer. A quantity of approximately 11 lbs. of the powder blend was isostatically pressed into a $\frac{7}{8}$-inch by $\frac{7}{8}$-inch by approximately 15-inch long bar at a compacting pressure of 40,000 psi. The compacted bar was sintered by direct-resistance self-heating to a temperature of 2380° C. for $3\frac{1}{2}$ hrs under vacuum (less than $10^{-5}$ torr), cooled under vacuum, repressed isostatically at 80,000 psi to increase the density of the bar, resintered by direct-resistance heating to a temperature of 2400° C. for $3\frac{1}{2}$ hrs under vacuum, and cooled under vacuum. The resulting double-sintered wire bar analyzed: 21 ppm Cb, 44 ppm Fe, 50 ppm Ni, less than 50 ppm W, less than 10 ppm Cr, less than 10 ppm C, 102 ppm $O_2$, 14 ppm $N_2$, less than 10 ppm each Ca, Mg and Mn, 120 ppm Si by emission spectroscopy, and less than 100 ppm Th (lower limit of detection) by optical plasma emission.

Similar bars were prepared in which the amount of silicon added was also 125 ppm, but in which the amount of thorium added, as thorium nitrate, was 100, 200 and 400 ppm, respectively. Samples of these bars, after sintering, showed about 125 ppm Si by emission spectroscopy in all cases, and less than 100, about 100 and about 200 ppm thorium by optical plasma emission, respectively. Another group of bars was similarly prepared, except that no silicon was added, and the amount of thorium added, as thorium nitrate, was 50, 100, 200 and 400 ppm, respectively. Optical plasma emission analyses of samples of these bars, after sintering, showed less than 10 ppm Si in all cases, and less than 100, about 100 and about 200 ppm thorium, respectively. An additional bar was prepared using the same lot of tantalum powder as for the above bars, except that no additions of silicon or thorium were made. This bar, and wire subsequently produced from it, are hereafter referred to as the "undoped control".

Each $\frac{7}{8}$-inch square cross-section double-sintered wire bar was cold-rolled to a 0.440-inch round-cornered square cross-section bar, degreased in perchloroethylene, acid pickled in a nitric-hydrofluoric-sulfuric acid solution to obtain a chemically clean surface, and annealed at 1300° C. for 60 minutes under vacuum ($10^{-4}$ torr) Each annealed 0.440-inch bar was then further cold-rolled to a 0.147-inch cross-section round-cornered square cross-section, at which size it was coiled. The coil was cleaned by degreasing followed by acid etching, as described above, and again annealed at 1300° C. for 60 minutes under vacuum. Each 0.147-inch round-cornered square cross-section wire was then rolled using square roll passes to a 0.089-inch round-cornered square cross-section, and given a rounding pass in semi-round cross-section rolls to a 0.083-inch diameter. The 0.083-inch diameter wire was cleaned by degreasing and acid pickling, and then was vacuum annealed as described above. The 0.083-inch diameter wire was drawn to the final wire size of 0.019-inch diameter. The wire in the finished diameter was given a light etch in a solution composed of 1300 ml. of 48% hydrofluoric acid, 450 ml. of 70% nitric acid, 600 ml. of 98% sulphuric acid and 2500 ml. of deionized water. Then the wire was annealed in vacuum for 60 minutes at 1300° C.

The wire was spooled and inspected for surface quality at a magnification of 10X to reveal possible presence of any defects such as silvers, delaminations, pits or other imperfections that could be detrimental to the quality of the wire. Specimens of wire of each composition were annealed at 2000° C. (3630° F.) for 30 minutes in vacuum (less than $10^{-5}$ torr). Microstructures of each sample, taken both transverse to and parallel to the wire axis, were examined. All wires were fully recrystallized. The average ASTM grain size numbers are plotted as a function of the added amount of thorium for the two silicon levels (0 and 125 ppm) in FIG. 1. These data show that silicon addition resulted in a finer grain size of about one grain size number over the entire range of 0 to 400 ppm added thorium. Thorium had a potent effect on grain size, resulting in a finer size of about four grain size numbers with 400 ppm added thorium at either added silicon level. The synergetic effect of 125 ppm added silicon and 400 ppm added thorium resulted in an ASTM grain size No. 10, compared to No. 5 for the undoped control.

In order to determine the resistance to embrittlement of the wire samples in a capacitor anode, a test was run under conditions designed to simulate the embrittlement of tantalum wire that can occur under the most severe conditions. A total of five samples of each wire diameter were cut to lengths of approximately $\frac{3}{4}$-inch, and the wires were pressed into cylindrical pellets of tantalum powder of approximately 10 microns average particle size containing about 2400 to 2500 ppm oxygen. The wires were embedded to a depth of $\frac{1}{8}$-inch in the anodes, which were 0.258-inch diameter, 0.350±0.010-inch height and weighed 2.0±0.1 grams each. A reference undoped standard wire (not containing any additions), whose performance had been previously established by the test procedures, was included in the test for comparison purposes. The tantalum powder anodes were pressed, without an added binder, to a density of 7.5 g/cc. The pressed anodes with the embedded lead wires were placed symmetrically onto sintering trays. Included in each sintering run, along with the anodes containing the test wires, were anodes made with the reference standard wire. The anodes were sintered in a cold-wall furnace at an absolute pressure of $10^{-5}$ torr for 30 minutes at an optical temperature of 2000° C.±10° C.

Following sintering, the anodes with the test wires and the control wire were anodized at 35 millamperes per gram in 0.01% phosphoric acid at 90°±2° C. until 100 volts was reached, and then maintained at 100 volts for 1 hour. The anodized anodes were thoroughly washed, and then dried in a circulating oven at 125° C. for 1 hour. The dried anodes were given a second sinter in a cold-wall furnace under vacuum ($10^{-5}$ torr) for 30 minutes at an optical temperature of 2000°±10° C.

The lead wires in the sintered anodes were repeatedly bent at a point $\frac{1}{8}$-inch above the point of egress of the anode. A $\frac{1}{8}$-inch thick die with a hole in the center was placed over the lead wire and served to control the position where the bend occurred in the bend test. The wires were bent over the $\frac{1}{8}$-inch thick die to an angle of 90°, and then were bent back up again to the vertical position. This total motion was defined as one bend in the wire. Successive bends were made in a like manner, but the direction of force was rotated 60° between consecutive bends. The number of bends before the wires failed by breaking was determined. From the data, a bend ratio was calculated which compares the number of bends to failure for the test wire to that of the reference standard control wire of the same diameter tested under the same conditions. (For a satisfactory test, the number of bends obtained for the control wire should average in the range of 1–5 bends.) The number of bends for the control wire (no additions) was normalized to bend ratio value of 1.0 in these comparisons.

Figure 2:
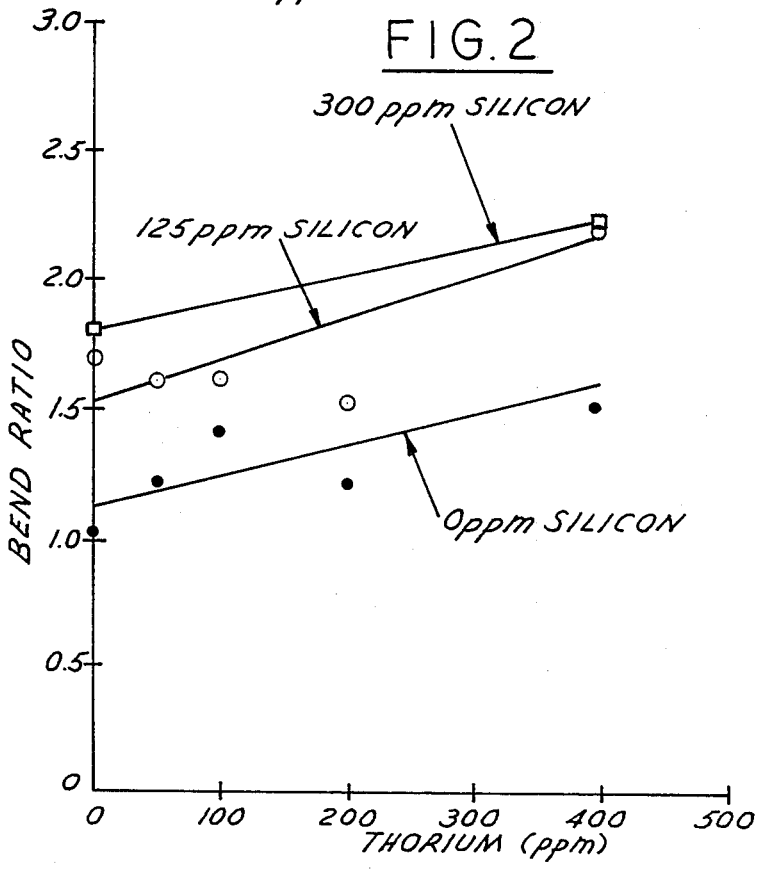
FIG. 2 is a graphic illustration of bend ratio of tantalum wire as a function of thorium content at three levels of silicon content.

FIG. 2 shows least-squares fitted curves for the bend ratio data from these tests as related to the added amount of thorium for the two silicon levels: none (0) and 125 ppm. The addition of 125 ppm silicon alone, with no added thorium, resulted in an increase of about 60% (bend ratio of 1.6 compared to 1.0 for the undoped control). The addition of thorium alone, up to 400 ppm added, resulted in an increase of about 40% in the bend ratio. The combined effect of 125 ppm added silicon and 400 ppm added thorium resulted in an increase of about 100% in bend ratio.

EXAMPLE 2

Additional doped tantalum wires were prepared as described in Example 1 except that: 300 ppm silicon and no thorium was added in one case, and 300 ppm silicon and 400 ppm thorium were added in another case. The bend ratio data are also shown in FIG. 2. The addition of 300 ppm silicon resulted in a bend ratio of 1.8 (80% increase compared to the undoped control). The addition of 300 ppm silicon and 400 ppm thorium resulted in a bend ratio of about 2.2, a 120% increase compared to the undoped control.

EXAMPLE 3

Specimens of the doped and undoped wires of Example 1 were spot welded in a T-joint to unalloyed nickel wire. Tensile tests on the joined tantalum-to-nickel wires showed that satisfactory joint strength was achieved in all cases.

Discussion

All of these data, considered together, indicate that the combined effects of silicon and thorium in tantalum wire result in a finer grain size and improved resistance to grain growth at very high temperatures, along with improved resistance to embrittlement during sintering of tantalum powder anodes, than can be achieved without additions or with either addition alone. Thus, these additive elements to tantalum result in a wrought tantalum product processing a unique combination of desirable characteristics.

In the preceding examples, the thorium was added as a thorium nitrate solution, an exemplary mode of addition. During subsequent processing of the tantalum bars, the thorium nitrate is dissociated, and the thorium remains in the tantalum in the form of fine relatively uniformly dispersed thorium oxide (i.e. thoria, $ThO_2$) particles. Essentially equivalent dispersed thoria particles can be obtained by adding the thorium as other soluble salts (e.g. thorium carbonate), or as a thoria sol, or as an insoluble or low solubility salt (e.g. thorium oxalate) dispersed as a slurry in an aqueous or organic solution.

The thoria particles, once formed, are thermodynamically stable during processing of the tantalum bar and wire. This is because thorium oxide ($ThO_2$) has a substantially more negative standard free energy of formation than does tantalum oxide ($Ta_2O_5$). (Reed, "Free Energy of Formation of Binary Compounds, an Atlas of Charts for High-Temperature Chemical Calculations," MIT, 1971). Furthermore, the melting point of thorium oxide is 3220°±50° C. ("Handbook of Chemistry and Physics, Physical Constants of Inorganic Compounds," 60th Edition, Edited by R. C. Weast, Chemical Rubber Co., 1979). This is above the temperature of 2400° C. used in sintering the tantalum bars.

Certain other metal oxides that are thermodynamically stable with respect to tantalum, and that have a melting point above 2400° C, can be used as alternates to thorium oxide. These metal oxides and their melting points are:

| Metal Oxide | Melting Point, °C. |
|---|---|
| $ThO_2$ | 3220 |
| MgO | 2800 |
| $HfO_2$ | 2758 ± 25 |
| $ZrO_2$ | 2715 |
| $CeO_2$ | 2600 |
| CaO | 2580 |
| BeO | 2530 ± 30 |
| $Y_2O_3$ | 2410 |

These metal oxides can be added to the tantalum in the form of: a fine metal powder which can subsequently be oxidized in-situ, such as by reaction with oxygen associated with the tantalum; as a metal oxide powder, either as dry powder or in sol or slurry form; or as a soluble or insoluble salt of the metal dissolved or slurried in an aqueous or organic solvent or carrier, which subsequently is thermally decomposed to produce the metal oxide. The metal oxides can be utilized singularly or in combination with each other or with thorium. The preferred silicon content is indicated to be in the range from about 70 to 700 ppm, although benefits from this addition are observed over a broader range from about 10 to 1000 ppm. The most preferred range has been found to be from about 100 to 500 ppm silicon. The beneficial effects from the further addition of a metal oxide-producing species is noted from about 10 to 1000 ppm on a contained metal basis, with 50 to 500 ppm being a preferred range.

The benefits of additions of both silicon and a stable metal oxide have been shown for unalloyed tantalum in the Examples. The term "unalloyed tantalum" refers to normal commercially pure tantalum metal—i.e. tantalum including the usual small amounts if impurity elements present, such as those listed in Example 1. Benefits from additions of silicon and a stable metal oxide can also be obtained in tantalum-based alloys. An example is a tantalum 7.5% tungsten alloy produced by Fansteel Inc. and sold under the commercial designation Tantaloy "61". This alloy is produced by a power metallurgy process similar to that described for unalloyed tantalum in Example 1. For producing Tantaloy "61", fine particle size high tantalum and tungsten powders are blended (92.5% Ta and 7.5% W). Silicon and thorium nitrate additions can be added to this blend, and the resultant doped powder blend is processed, sintered and worked to wire or other desired mill product.

The benefits of silicon and stable metal oxide additions to tantalum and tantalum alloys also can be applied to other metals of Group V of the Periodic Table of the Elements, namely niobium (columbium), and vanadium, and alloys of these metals.

The invention claimed is:

1. In a wrought tantalum-based product, the improvement which comprises inclusion of about 10 to about 1000 ppm silicon in combination with about 10 to about 1000 ppm total of one or more metals in oxide form having high free energies of formation as compared with tantalum and which possess an oxide melting temperature in excess of 2400° C.

2. The improvement set forth in claim 1 wherein said one or more metals are selected from the group consisting of thorium, magnesium, hafnium, zirconium, cerium, calcium, beryllium and yttrium.

3. The improvement set forth in claim 1 wherein said tantalum-based product is of substantially pure unalloyed tantalum but for said inclusion.

4. The improvement set forth in claim 3 wherein said one or more metals consist of thorium.

5. The improvement set forth in claim 4 wherein said silicon is in the amount of about 70 to 700 ppm, and said thorium is in the amount of about 50 to 500 ppm.

6. The improvement set forth in claim 5 wherein said silicon is in the range of about 100 to 500 ppm.

7. A tantalum wire composed of substantially pure unalloyed tantalum containing about 10 to 1000 ppm silicon in combination with about 10 to 1000 ppm total of one or more metal oxides having melting points of at least 2400° C. and more negative standard free energies of formation than tantalum oxide up to at least 2400° C.

8. The tantalum wire set forth in claim 7 wherein said one or more metal oxides are selected from the group consisting of oxides of thorium, magnesium, hafnium, zirconium, cerium, calcium, beryllium and yttrium.

9. The tantalum wire set forth in claim 8 wherein said silicon is in the amount of about 70 to 700 ppm.

10. The tantalum wire set forth in claim 9 wherein said silicon is in the amount of about 100 to 500 ppm.

11. The tantalum wire set forth in claim 10 wherein said one or more metal oxides are in the amount of about 50 to 500 ppm total.

12. The tantalum wire set forth in claim 8 wherein said one or more metal oxides are in the amount of about 50 to 500 ppm total.

13. The tantalum wire set forth in claim 12 wherein one or more metal oxides consist of a single metal oxide selected from said group.

14. The tantalum wire set forth in claim 13 wherein said metal oxide is thorium oxide.

15. A metal-based product composed of a base metal selected from the group consisting of tantalum, niobium (columbium), vanadium and alloys of these metals, 10 to 1000 ppm silicon, and 10 to 1000 ppm total of one or more metal oxides having melting points of at least 2400° C. and more negative standard free energies of formation than does the oxide of said base metal up to at least 2400° C.

16. The product set forth in claim 15 wherein said one or more metal oxides are selected from the group consisting of oxides of thorium, magnesium, hafnium, zirconium, cerium, calcium, beryllium and yttrium.

17. The product set forth in claim 16 wherein said metal oxide is thorium oxide.

18. The product set forth in claim 17 wherein said silicon is in the amount of about 70 to 700 ppm, and said thorium is in the amount of about 50 to 500 ppm.

* * * * *